United States Patent [19]

Breslow et al.

[11] 4,160,548

[45] Jul. 10, 1979

[54] ACTION GAME APPARATUS

[75] Inventors: Jeffrey D. Breslow, Highland Park; Eugene Jaworski, Park Ridge, both of Ill.

[73] Assignee: Marvin Glass & Associates, Chicago, Ill.

[21] Appl. No.: 854,220

[22] Filed: Nov. 23, 1977

[51] Int. Cl.[2] ..... A63F 9/14

[52] U.S. Cl. ..... 273/1 M; 46/240

[58] Field of Search ..... 273/1 M; 46/240

[56] References Cited

U.S. PATENT DOCUMENTS

| | | | |
|---|---|---|---|
| 1,858,020 | 5/1932 | Linke | 273/1 M X |
| 2,747,872 | 5/1956 | Harvey | 273/1 M |
| 3,214,171 | 10/1965 | Luchsinger | 273/1 M X |
| 3,625,516 | 12/1971 | Handweiler et al. | 273/1 M X |

FOREIGN PATENT DOCUMENTS

| | | | |
|---|---|---|---|
| 526 of | 1915 | United Kingdom | 273/1 M |

*Primary Examiner*—Paul E. Shapiro

*Attorney, Agent, or Firm*—Mason, Kolehmainen, Rathburn & Wyss

[57] ABSTRACT

An action game apparatus for testing manual skill and dexterity comprises a housing having a thin transparent sheet forming a playing surface and a magnet is manually movable over one face of the playing surface to attract and move a magnetic playing piece on the opposite face of the playing surface towards a goal. The playing surface is provided with walls defining a tortuous path leading to the goal and as the playing piece is moved along the tortuous path, it is subjected to bombardment from projectiles which are randomly propelled in the general vicinity of the playing piece. If a projectile strikes the playing piece with enough force, the magnetic attraction between the manually movable magnet and the attracted playing piece is broken and the player must start again and reestablish magnetic contact before movement toward the goal can again proceed. The game requires skill and manual dexterity in moving the playing piece as fast as possible around the tortuous path to the goal while trying to avoid the projectiles randomly fired.

8 Claims, 4 Drawing Figures

ACTION GAME APPARATUS

BACKGROUND OF THE INVENTION

1. Field of the Invention

The present invention relates to a new and improved action type game apparatus and more particularly a game apparatus designed to require skill and manual dexterity on the part of the players.

2. Description of the Prior Art

Many action type games requiring skill and manual dexterity have been developed to provide amusement for both children and adults. Some games have provided a magnetic playing piece which is movable over a surface because of the magnetic attraction between the playing piece and a variety of different types of manipulated magnetic objects. In addition, other prior art games have included systems for firing projectiles at various types of targets on a random basis and in random directions. Moreover, other prior art games have included maze-type enclosures wherein the paths of movement for playing pieces and the like are restricted from a normal or shortest distance between two points.

The present invention provides a novel game apparatus encompassing many different types of action features and it is an object of the present invention to provide a new and improved game apparatus of the character described which requires skill and manual dexterity and which includes a random element of chance in determining success or failure when playing the game.

More particularly, it is an object of the present invention to provide a new and improved game apparatus of the character described wherein a playing piece is movable by means of magnetic attraction around a tortuous path toward a goal.

Yet another object of the present invention is to provide a new and improved game apparatus of the character described wherein a playing piece is moved by magnetic means toward a goal in the face of randomly fired projectiles which may occasionally strike the playing piece and break the magnetic couple. The player may then be required to start over again and recouple or reestablish the magnetic attraction of the playing piece before movement toward the goal can again commence.

Another object of the present invention is to provide a new and improved game apparatus of the character described which is relatively compact in size, simple in construction and economical to produce.

Another object of the present invention is to provide a new and improved game apparatus of the character described wherein a playing piece is movable toward a protective goal in the face of projectiles which are fired at random times and in random directions generally toward the playing piece as it is moved.

Still another object of the present invention is to provide a new and improved action type game apparatus wherein skill and manual dexterity are emphasized and yet an element of randomness or chance is included in determining success or failure in playing the game.

Still another object of the present invention is to provide a new and improved game apparatus of the character described employing a new and improved means for propelling projectiles along a surface on a random basis in random directions.

SUMMARY OF THE INVENTION

The foregoing and other objects and advantages of the present invention are accomplished in an illustrated embodiment which comprises a new and improved game apparatus including a thin transparent sheet forming a playing surface. A hand held member with a magnetic surface thereon is manually movable over one face of the playing surface and by magnetic attraction a playing piece on the opposite side of the playing surface is movable therewith towards a goal defined on the playing surface. Walls or ridges are provided on the playing surface to provide a maze-like tortuous path for directing the movement of the hand held member toward the goal. The game includes a mechanism for firing or propelling balls or projectiles at random times and in random directions generally in the direction of the magnetic playing piece and when a projectile strikes the playing piece as it is being moved toward the goal, the magnetic attraction between the hand held member and the playing piece may be interrupted and the playing piece knocked away. This can end a round of play or the player may again try to pick up the playing piece and start its movement toward the goal. The game apparatus thus requires skill and manual dexterity and in addition, has an element of chance or randomness during play.

BRIEF DESCRIPTION OF THE DRAWINGS

For a better understanding of the present invention, reference should be had to the following detailed description, taken in conjunction with the drawings in which.

DESCRIPTION OF THE PREFERRED EMBODIMENT

Figure 1:
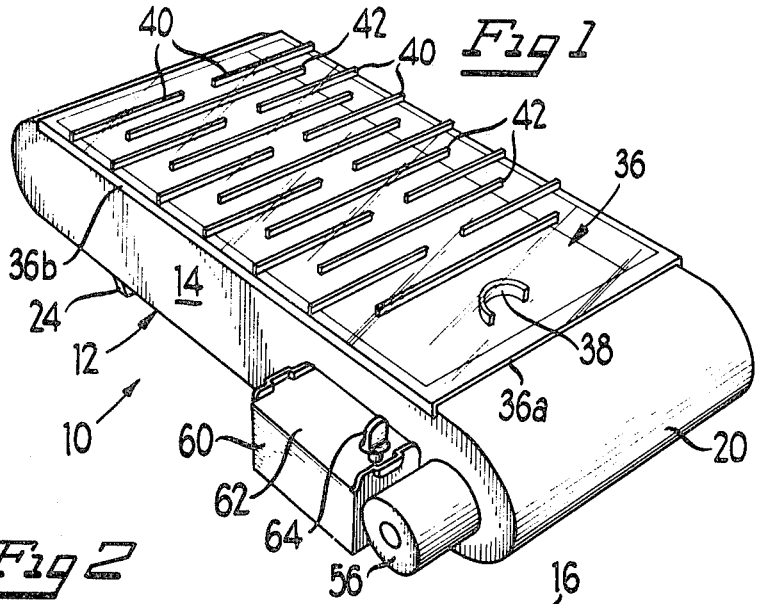
FIG. 1 is a perspective view of a new and improved game apparatus constructed in accordance with the features of the present invention and shown in position ready for play.
Figure 3:
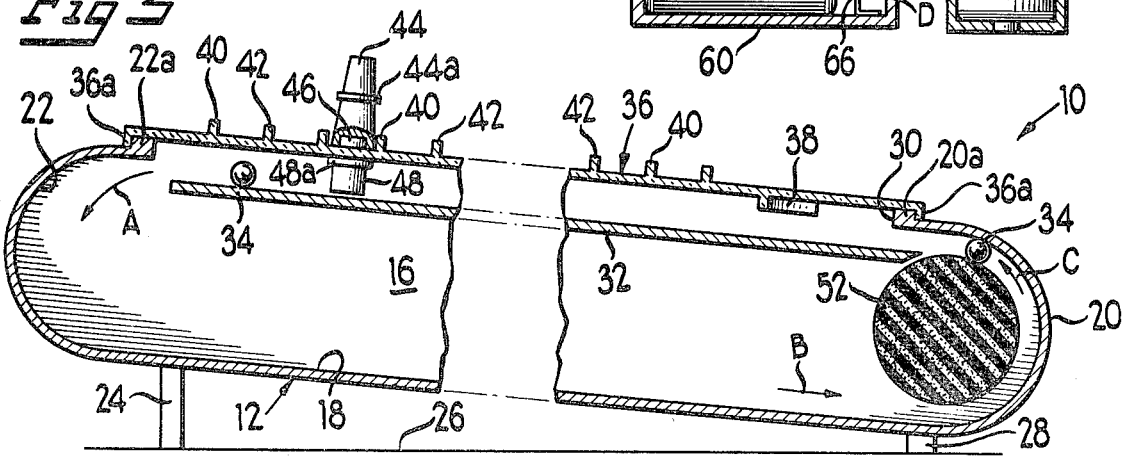
FIG. 3 is a longitudinal sectional view of the game apparatus.

Referring now more particularly to the drawings, in FIG. 1 is illustrated a new and improved game apparatus constructed in accordance with the features of the present invention and referred to generally by the reference numeral 10. The game apparatus 10 includes a hollow enclosure 12 preferably formed of molded plastic material and including a pair of flat opposite side walls 14 and 16, a bottom wall 18 and a semicylindrically shaped lower end wall 20 and a similarly shaped opposite upper end wall 22. A depending foot or leg 24 is formed adjacent the upper end portion of the bottom wall 18 to support the game apparatus in position as shown in FIG. 3 on a playing surface 26 and a lower foot 28 of shorter length is provided adjacent the lower end of the enclosure so that the bottom wall 18 of the enclosure slopes downwardly as shown when placed on a level playing surface.

The hollow enclosure 12 is provided with an enlarged rectangular opening 30 defined between opposite upper edges of the side walls 14 and 16 and a pair of transversely extending ribs **20*a* and 22*a* respectively, on the upper and lower end walls extending between the opposite side walls. The large rectangular opening 30 thus provides open viewing of an intermediate supporting surface 32 spaced upwardly and parallel of the bottom wall 18 between the opposite side walls and spaced below the underside of the rib portions 20***a* and 22*a* as shown. This spacing is sized to permit round balls or projectiles 34 on the upper surface of the support surface 32 to pass freely between the opposite end portions of the hollow enclosure as indicated by the arrows "A" and "B" in FIG. 3 in a random race track pattern. The ball support surface 32 is approximately the same in area or size or slightly larger than the rectangular opening 30 in the upper wall portion of the hollow enclosure 12 and substantially all of the upper surface of the member 32 is clearly visible through the opening 30.

Figure 2:
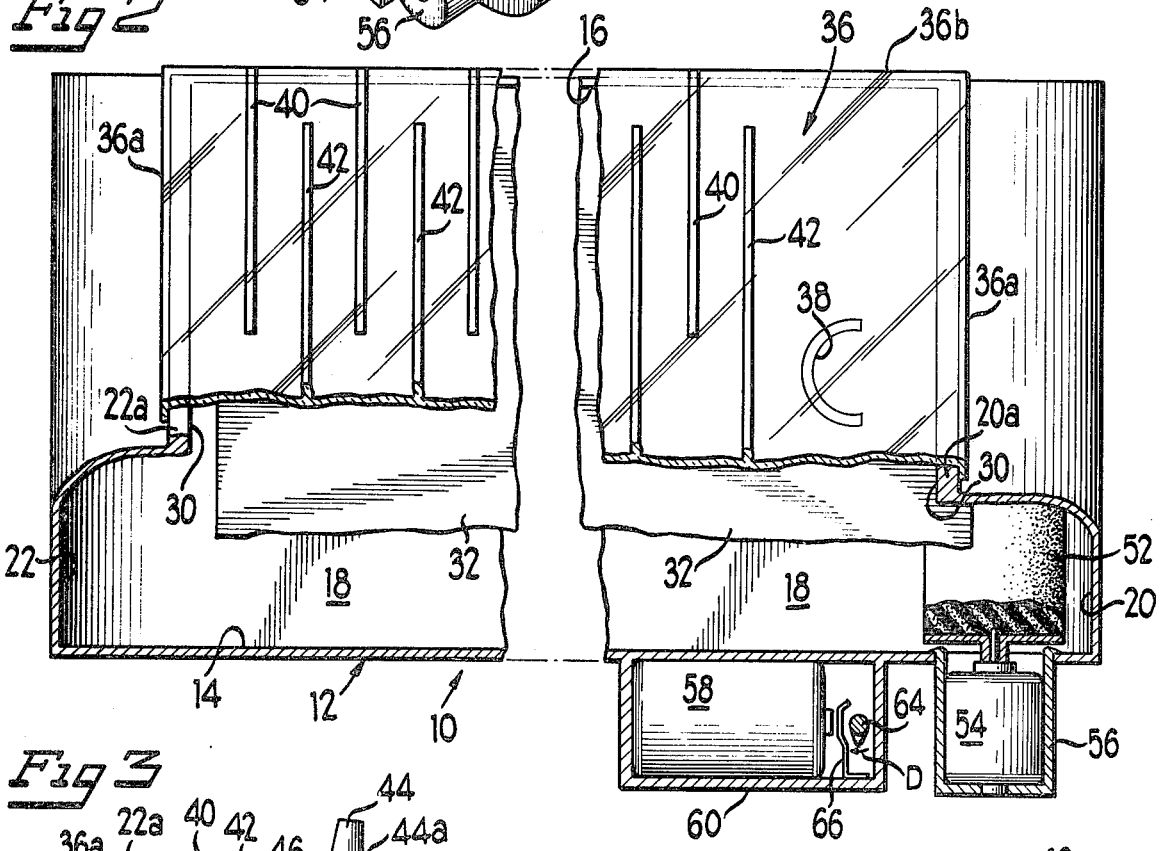
FIG. 2 is a top plan view of the game apparatus with portions broken away and in section.

In accordance with the present invention, the game apparatus includes an upper playing surface provided on a cover 36 formed of thin, transparent plastic material. The cover is adapted to snap on to the ribs 20*a* and 22*a* and over the upper edges of the opposite side walls 14 and 16 as shown in FIGS. 2 and 3. When in place, the cover encloses the opening 30 in the housing 12 yet permits the interior of the upper surface of the support 32 to be viewed as the balls 34 are fired or projected upwardly from the lower end towards the upper end of the housing. For this purpose, the cover 36 is formed with a downturned flanges 36*a* and at opposite upper and lower ends and similar, deeper flanges 36*b* on opposite edges of snap-on engagement with the upper edge portions of the opposite side walls 14 and 16.

On the underside of the cover 36 there is provided a goal 38 formed adjacent a lower end portion by a semicircular wall depending downwardly from the underside of the playing surface. The upper surface of the transparent cover is formed with a plurality of parallel, laterally extending, upstanding ribs 40 and 42 arranged in alternate rows to define a continuing tortuous path or maze between the upper end of the playing surface on the cover and the goal 38. As indicated, the ribs 40 are formed in aligned pairs and are relatively short with their inner ends spaced apart as shown. The alternate ribs 42 are longer but are shorter in length that the width of the playing surface to permit passage around either outside ends as will be described hereinafter.

Figure 4:
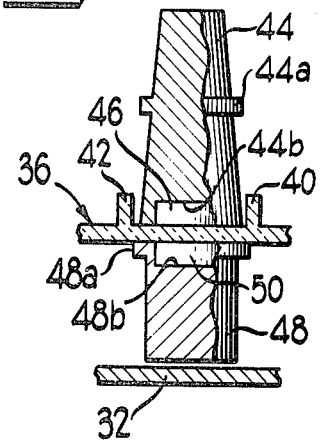
FIG. 4 is an enlarged fragmentary sectional view illustrating the interrelation between the hand held magnetic member, the magnetic playing piece and transparent playing surface of the game apparatus.

The ribs 40 and 42 define a maze-like arrangement or path on the playing surface of the cover 36 to preclude a player from moving a hand manipulated member 44 (as best shown in FIG. 4) directly towards the goal 38 while in contact with the upper playing surface of the cover. As indicated in FIG. 4, the hand member 44 is of generally frustroconical shape including an annular rib 44*a* intermediate its ends to facilitate handling or grasping by a player. At the lower end, the member 44 is provided with a cylindrical recess 44*b* in which is mounted a relatively strong, cylindrical, permanent magnet 46. The lower end portion of the member 44 is sized to permit free passage between the parallel ribs 40 and 42 and downwardly between spaced apart, inner ends of aligned pairs of the ribs 40 at the center of the cover. The member 44 is also movable about the outer ends of the ribs 42 while maintaning contact between the lower face of the permanent magnet 46 and the upper playing surface of the cover. The hand manipulated member 44 is adapted to move by magnetic attraction a playing piece 48 of generally cylindrical shape which is mounted between the underside of the cover 36 and the ball support 32 as best shown in FIG. 4. The playing piece 48 is provided with an enlarged annular lip 48*a* around the upper end and a cylindrical recess 48*b* is defined in the upper end surface in oder to accommodate a permanent magnet 50 similar to the permanent magnet 46. When the hand held member 44 is positioned directly above the playing piece 48, magnetic attraction between the permanent magnets 46 and 50 of the respective members brings the member into close proximity as shown with their adjacent facing surfaces in contact with the upper and lower surfaces of the cover 36. Accordingly, when the magnet 46 is moved around the playing surface between the ribs 40 and 42 the playing piece 48 is carried along on the underside of the cover until such time as the playing piece is knocked away by a ball 34 or the member 44 is moved out of contact with the cover 36. A magnetic force couple is established between the member 44 and the playing piece 48 so that the two move in unison around the surface of the cover 36 until the magnetic couple is broken or interrupted.

In order to add an element of chance to the game, the game apparatus includes a ball propelling cylindrical roller 52 formed of compressible resilient material mounted for rotation adjacent the semicylindrical lower end wall 20 of the hollow enclosure 12. As illustrated in FIG. 3, the outer surface of the roller 52 is spaced from the inside surface of the lower end wall 20 by a distance slightly less than the diameter of the balls 34 so that the balls are picked up by the roller 52 and move in a counterclockwise direction as illustrated by the arrows "C" before being propelled upwardly across the upper surface of the support member 32. The roller 52 is driven from one end by an electric motor 54 mounted in a cylindrical housing 56 secured to the closure side wall 14 as shown in FIGS. 1 and 2. The electric motor in turn is powered by a battery 58 mounted in a battery case 60 with a removable top plate 62 having a switch operator 64 mounted therein. As shown in FIG. 2, the switch operator 62 includes a cam which is movable to make contact between a deflectable switch element 64 and the center terminal of the battery 58 so that the motor may be turned on and off by rotation of the upper end of the switch operator. When the switch operator is rotated in a clockwise direction as shown by the arrow "D" in FIG. 2, the contact 66 is moved to make electrical contact with the central terminal of the battery 58 and a circuit is completed to power and run the electric motor 54 via a pair of motor leads (not shown). The electrically powered roller 52 provides an element of chance in playing of the game by forcefully propelling one or more balls 34 across the upper surface of the support member 32 in the general direction of the playing piece as the playing piece is being manipulated by movement of the member 44 toward the goal 38. When the balls pass over the upper edge of the support surface 32 as indicated by the arrow "A" they fall to the bottom wall 18 and roll back downwardly on the bottom wall to again be picked up and pinched between the outer surface of the compressible roller 52 and the inside surface of the lower end wall 20 of the hollow enclosure 12. The balls are moved upwardly around the lower end wall by the roller as indicated by the arros "C" are fired or propelled on release to roll over the upper surface of the support 32. The release or firing of the balls is random in nature and the precise direction of travel depends upon a variety of factors which are also somewhat random in nature. Accordingly, a person playing the game attempts to move the playing piece 48 in a manner to avoid being hit by the rolling balls 34 fired upwardly on the member 32 by rollers 52.

In one form of play, the game may be terminated whenever a ball 34 strikes the playing piece 48 and knocks it away out of the magnetic couple or attraction with the hand held member 44. In another style of play, the winner of the game may be determined by the amount of time that it takes player to move the playing piece 44 from the upper pair of ribs 40 into the goal 38 regardless of the number of times that one of the balls 34 may strike the playing piece and knocks it away out of a magnetic couple or attraction with the manual element 44. The spacing between the surface 32 and the underside of the cover 36 is slightly larger than the height of the playing piece and accordingly, a magnetic couple can be reestablished after the playing piece is knocked away by a projectile by repositioning the hand movable member 44 directly above the playing piece 48. The game thus provides action and requires skill and manual dexterity and the random nature of firing the rolling balls 34 by the roller 52 adds an element of chance or luck to the game.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. A game apparatus, comprising:

a transparent sheet forming a playing surface;

a magnet manually movable over one side of the playing surface in contact therewith;

a magnetic playing piece positioned on an opposite side of said playing surface and attracted by said magnet for movement therewith toward a goal;

said playing piece including a magnet movable in contact with the opposite side of said playing surface when held by magnetic attraction from said magnet in juxtaposition therewith with said transparency therebetween; and wall means on said one side of the playing surface defining a tortuous path of travel for said magnet wherein said goal includes wall means on said opposite side for limiting movement of said playing piece in at least one direction.

2. The game apparatus of claim 1 including means for breaking up magnetic holding attraction between said magnetic means and said playing piece whereby the playing piece will not follow the movements of said magnetic means.

3. A game apparatus, comprising:

a thin transparent sheet forming a playing surface;

magnetic means manually movable over one face of said playing surface, said magnetic means including a magnet face movable in contact with said one face of the playing surface;

a magnetic playing piece positioned on an opposite face of said playing surface attracted by said magnetic means for movement therewith, said playing piece including a magnet face movable in contact with said opposite face of said playing surface when held against said face by magnetic attraction from the magnet face of said magnetic means in juxtaposition therewith with said transparent sheet therebetween;

a goal including wall means on the opposite face of said sheet for limiting movement of said playing piece in at least one direction on said face when said playing piece is positioned in said goal; and wall means on said one face including a plurality of wall segments defining at least one tortuous path for movement of said magnetic means toward said goal.

4. A game apparatus, comprising:

a thin transparent sheet forming a playing surface;

a manually movable magnet for movement over one face of said playing surface;

a magnetic playing piece positioned on an opposite face of said playing surface and attracted by said magnet for movement therewith toward a goal; and means for breaking the magnetic holding attraction between said magnet and said playing piece, said means comprising an apparatus for shooting projectiles randomly to strike said playing piece and knock said playing piece away from a position of concentrated magnetic attraction between the playing piece and said magnet.

5. The game apparatus of claim 4 wherein said apparatus comprises a supporting surface adjacent said playing surface for holding said projectiles in a path for random contact with said playing piece.

6. The game apparatus of claim 5 wherein said apparatus includes motor means for propelling said projectiles in random directions along said supporting surface.

7. The game apparatus of claim 6 wherein said apparatus includes means for returning said projectiles to said motor means to again be propelled over said supporting surface for striking said playing piece.

8. The game apparatus of claim 7 wherein said motor means includes a rotor of resilient material and a wall surface adjacent thereto for containing said projectiles in compressive contact with said rotor until released onto said support surface.

* * * * *